US012247451B2

(12) United States Patent
Fulks

(10) Patent No.: US 12,247,451 B2
(45) Date of Patent: Mar. 11, 2025

(54) METHOD AND APPARATUS FOR OPERATING HYDRAULIC EQUIPMENT THROUGH A ROTARY TABLE

(71) Applicant: Consolidated Rig Works, L.P., Fort Worth, TX (US)

(72) Inventor: Caleb E. M. Fulks, McKinney, TX (US)

(73) Assignee: Consolidated Rig Works, L.P., Fort Worth, TX (US)

( * ) Notice: Subject to any disclaimer, the term of this patent is extended or adjusted under 35 U.S.C. 154(b) by 0 days.

(21) Appl. No.: 18/362,554

(22) Filed: Jul. 31, 2023

(65) Prior Publication Data

US 2025/0043634 A1 Feb. 6, 2025

(51) Int. Cl.
*E21B 3/04* (2006.01)

(52) U.S. Cl.
CPC ..... *E21B 3/04* (2013.01)

(58) Field of Classification Search
CPC ..... E21B 3/04
See application file for complete search history.

(56) References Cited

U.S. PATENT DOCUMENTS 2,657,016 A * 10/1953 Grable ..... E21B 10/04 175/215
3,807,514 A * 4/1974 Murrell ..... E21B 3/04 175/215
2021/0254417 A1* 8/2021 Fulks ..... E21B 3/04

* cited by examiner

*Primary Examiner* — D. Andrews

(57) ABSTRACT

An apparatus for providing hydraulic power below a rotary table of a snubbing unit, comprising a swivel assembly including at least one hydraulic port therein. The swivel assembly defines a first hydraulic channel connected to the at least one hydraulic port. A rotary mounted within a rotary table has a second hydraulic port therein below the rotary table. The rotary defines a second hydraulic channel therein connected to the second hydraulic port. The rotary is connected to the swivel assembly such that the first hydraulic channel aligns with the second hydraulic channel to provide for hydraulic fluid flow therebetween. Hydraulic fluid is provided from the at least one hydraulic port through the first hydraulic channel of the swivel assembly and the second hydraulic channel of the rotary to the second hydraulic port below the rotary table.

19 Claims, 6 Drawing Sheets

METHOD AND APPARATUS FOR OPERATING HYDRAULIC EQUIPMENT THROUGH A ROTARY TABLE

TECHNICAL FIELD

The present invention relates to providing hydraulic power to components of a snubbing unit, and more particularly to providing hydraulic power below a rotary table within a snubbing unit through a swivel and rotary.

BACKGROUND

Within the operation of a snubbing unit, it is often necessary to insert additional pipe into a well bore or remove pipe during the drilling process. When adding or removing pipe from the pipe string, it is necessary to temporarily grip the pipe or pipe string so it does not slide into or push out of the well bore during the process. For purposes of this application, unless otherwise indicated the terms "pipe" and "pipe string" refer to drill pipe, drill strings, production pipe, production strings, jointed pipe and collars, jointed and continuous tubing, casing and other types of oilfield tubular members and strings formed of such tubular members. The devices for providing this gripping functionality are called slip bowls. Slip bowls may be located both above and below the rotary table and are powered using hydraulic hoses. However, when connecting hydraulic hoses to lower slip bowls located below the rotary table, there is the need for an individual to manually connect and disconnect the hydraulic hose by placing themselves under the rotary table. Hydraulic hoses must be disconnected when the rotary table is going to be actuated and then reconnected when rotation is stopped and power is again needed to the lower slip bowl. This is obviously a high-risk situation and if the rotary table is lowered accidentally or due to mechanical failure while an individual is connecting or removing the hydraulic hose, death or serious injury can result. If the operator forgets to disconnect the hydraulic connection prior to rotation, the equipment may be damaged and nearby personnel may be injured. Thus, there is a need for a system and method for providing hydraulic power to a lower slip bowl or other device below the rotary table without requiring the connection and disconnection of hydraulic hoses to the lower slip bowl or other hydraulically powered devices.

SUMMARY

The present invention, as disclosed and described herein, in one aspect thereof comprises an apparatus for providing hydraulic power below a rotary table of a snubbing unit having a swivel assembly including at least one hydraulic port therein. The swivel assembly defines a first hydraulic channel connected to the at least one hydraulic port. A rotary mounted within a rotary table has a second hydraulic port therein below the rotary table. The rotary defines a second hydraulic channel therein connected to the second hydraulic port. The rotary is connected to the swivel assembly such that the first hydraulic channel aligns with the second hydraulic channel to provide for hydraulic fluid flow therebetween. Hydraulic fluid is provided from the at least one hydraulic port through the first hydraulic channel of the swivel assembly and the second hydraulic channel of the rotary to the second hydraulic port below the rotary table.

BRIEF DESCRIPTION OF THE DRAWINGS

For a more complete understanding, reference is now made to the following description taken in conjunction with the accompanying Drawings in which.

DETAILED DESCRIPTION

Figure 1:
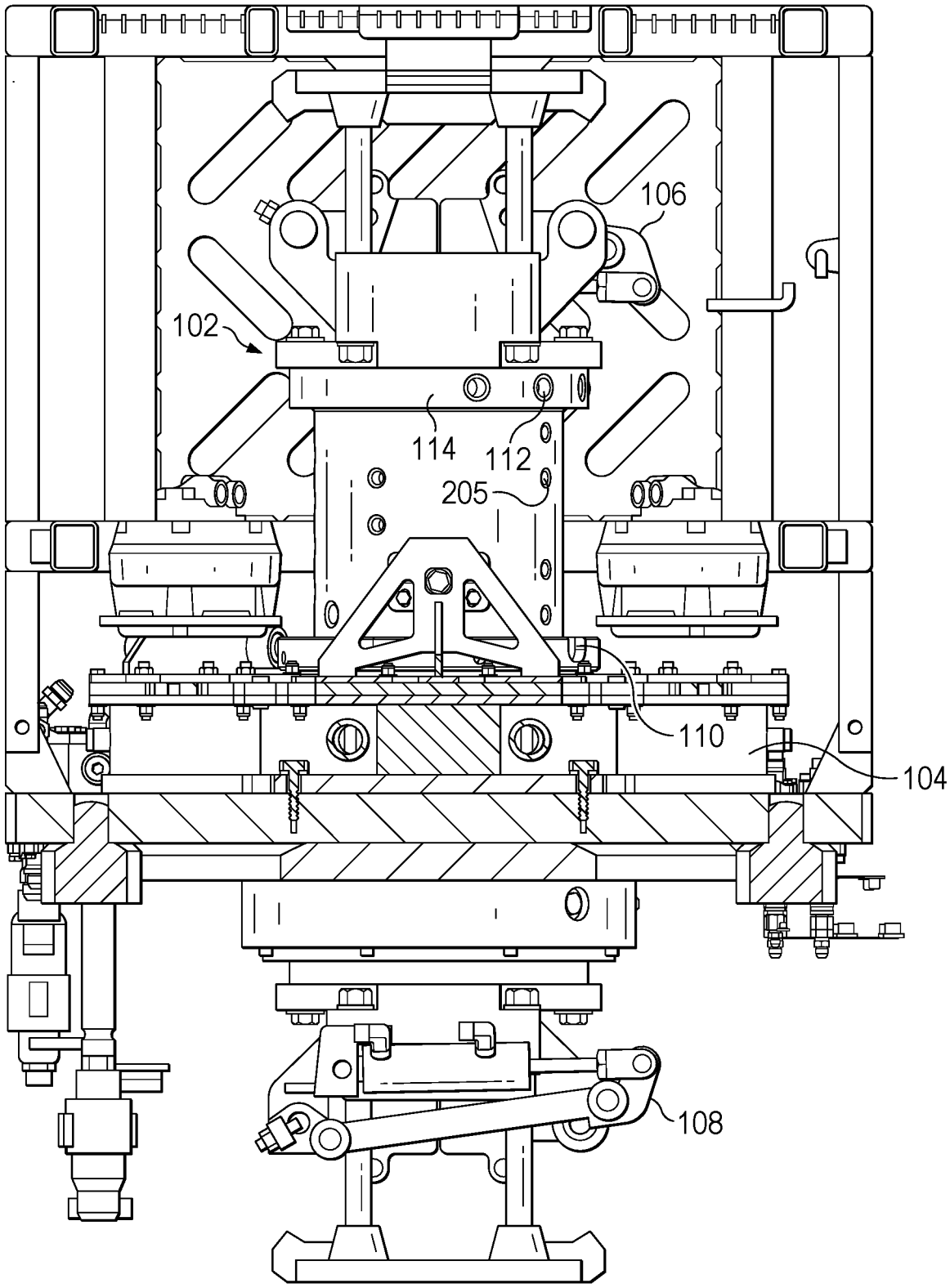
FIG. 1 illustrates a side view of a rotary table including an upper slip bowl and a lower slip bowl.

Referring now to the drawings, wherein like reference numbers are used herein to designate like elements throughout, the various views and embodiments of a system and method for providing power below a swivel and rotary table are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Referring now to the drawings, and more particularly to FIG. 1, there is illustrated a side view of a swivel 102, rotary table 104, upper slip bowl 106 and lower slip bowl 108. The upper slip bowl 106 and the lower slip bowl 108 are used for gripping pipe of the pipe string that is inserted through the bowls 106/108 during a drilling operation. The swivel 102 is used for providing 360° rotation of drilling pipe and rotates with the rotary 110 that is supported by the rotary table 104. Traditionally, the swivel 102 only supplies hydraulic fluid to power the upper slip bowl 106 above the rotary 110 and thus does not provide hydraulic fluid to power the lower slip bowl 108; rather the lower slip bowl 108 is traditionally powered by temporary lines originating from the rig floor and routed under the rotary for temporary attachment to the lower slip bowl 108 that must be disconnected when the rotary 110 is in use.

During operations, hydraulic fluid power must be provided to the upper slip bowl 106 and lower slip bowl 108 in order to have the slip bowls engage and disengage pipes which are inserted within the slip bowls. As discussed, previous methods for providing power to the lower slip bowl 108 involve having a temporary hydraulic hose connected below the rotary table 104 to the lower slip bowl 108, but this requires the removal of the hydraulic hose prior to rotation of the pipe string by the rotary 110 of the rotary table 104. Reconnection of the temporary hydraulic hose below the rotary table 104 is needed to further engage the lower slip bowl 108 in subsequent pipe gripping operations. The removal and connection of the temporary hydraulic lines below the rotary table 104 requires one of the rig workers to physically crawl under the rotary table and engage or disengage the temporary hydraulic connection at the lower slip bowl 108. This raises obvious safety issues if the rotary table 104 should unexpectedly move and could crush a rig worker located under the rotary table.

The system and method described herein enables the provision of hydraulic fluid for hydraulic power to input ports 205 located on the upper flange 114 of the swivel 102. Hydraulic fluids provided at the input port 205 are routed up to an output port 112 located at the top of the swivel 102 but output port 112 would have a plug therein when the lower port was being used. The hydraulic fluid would then be routed down through the swivel 102 and the rotary 110 to the lower slip bowl 108 without requiring the connection of hydraulic hoses below the rotary table to the lower slip bowl 108.

Figure 2:
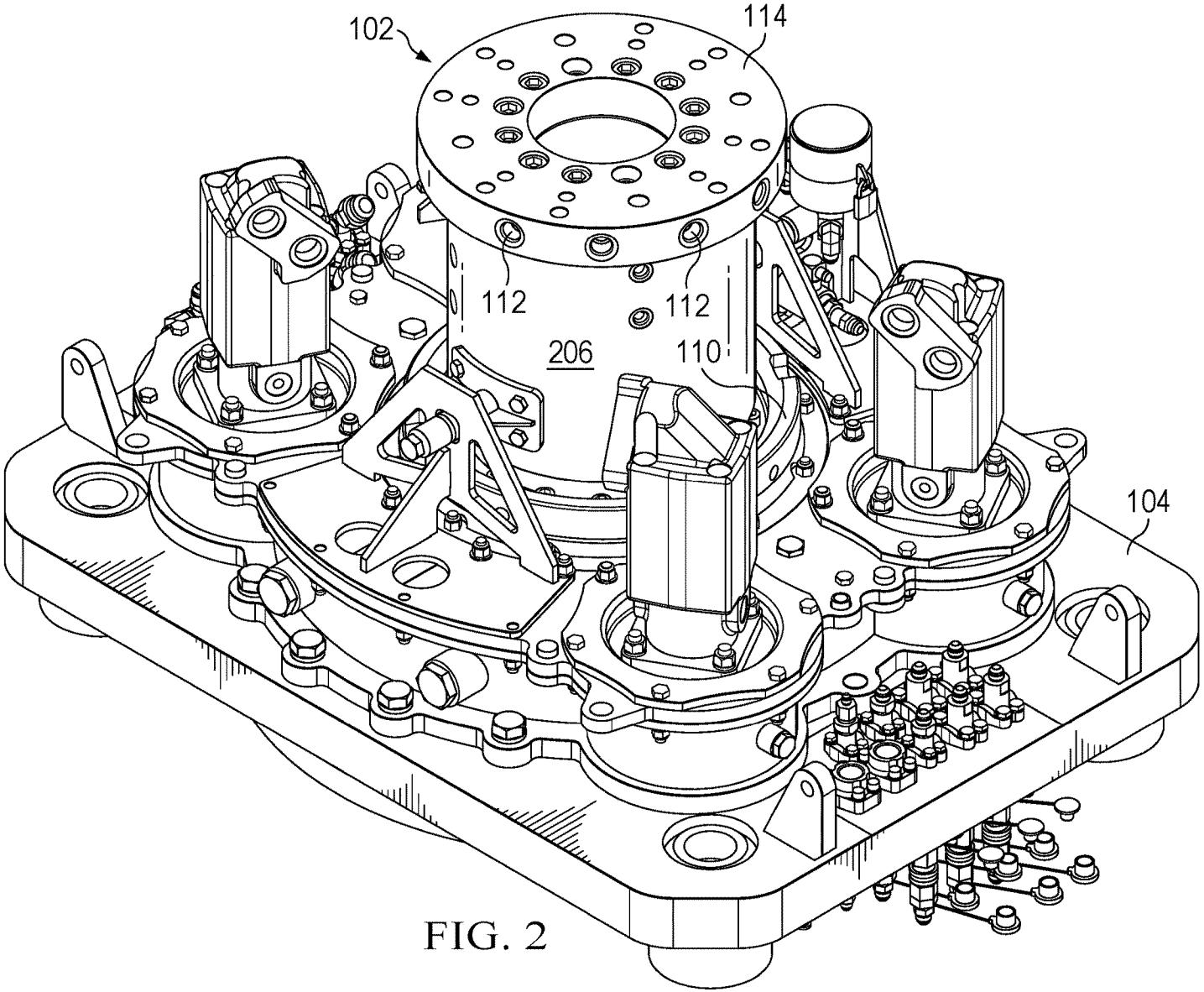
FIG. 2 illustrates a perspective view of a rotary table and swivel.
Figure 3:
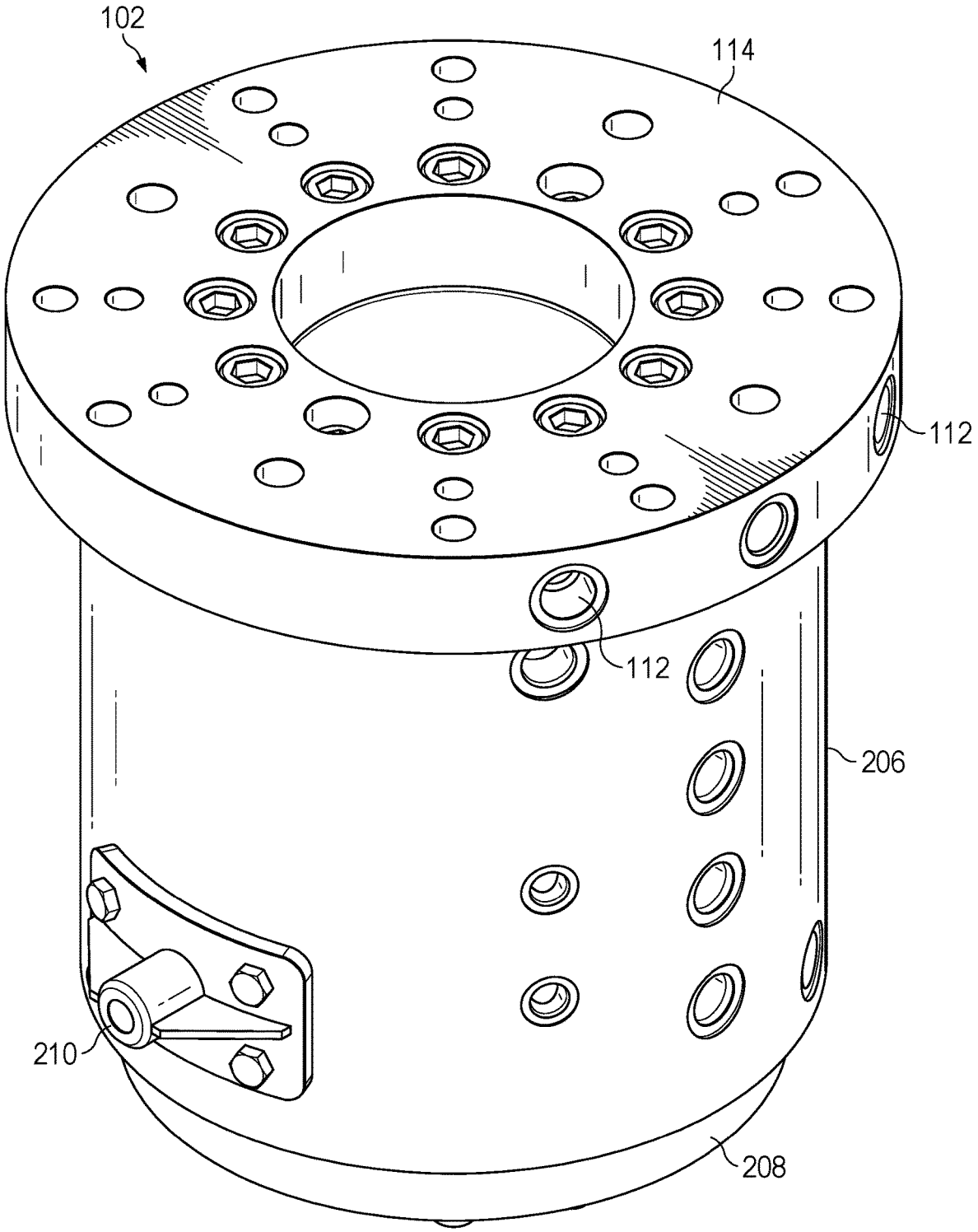
FIG. 3 illustrates a perspective view of a swivel.

Referring now to FIG. 2, there is illustrated a perspective view of the rotary table 104 and swivel 102. The swivel 102 includes an upper flange 114 defining several output ports 112 therein. The upper flange 114 is affixed to an annular swivel spindle 402 (FIG. 4) that is disposed inside of a fixed swivel housing 206. Referring now also to FIG. 3, there is illustrated a perspective view of the swivel assembly 102 as described herein above, the swivel 102 further includes a lower flange 208 affixed to the base of the swivel spindle 402. The lower flange 208 is used for affixing the swivel 102 to the rotary 110 such that the swivel 102 (including upper flange 114, swivel spindle 402 and lower flange 208) rotates with the rotary 110. The upper flange 114 rotates above the fixed swivel housing 206 when the swivel 102 rotates with the rotary 110. Multiple separate ports 112 are included within the upper flange 114 to enable the provision of hydraulic fluid to the swivel 102 via permanent hydraulic hoses (not shown) attached above the rotary table. In the illustrated embodiment, three separate ports 112 are provided on the upper flange 114; however, other embodiments may use a different number of ports. Anti-rotation bracket 210 operably connects the swivel housing 206 to the rotary table 104 to prevent the swivel housing 206 from rotating with the swivel 102 when the rotary 110 is rotated.

Figure 4:
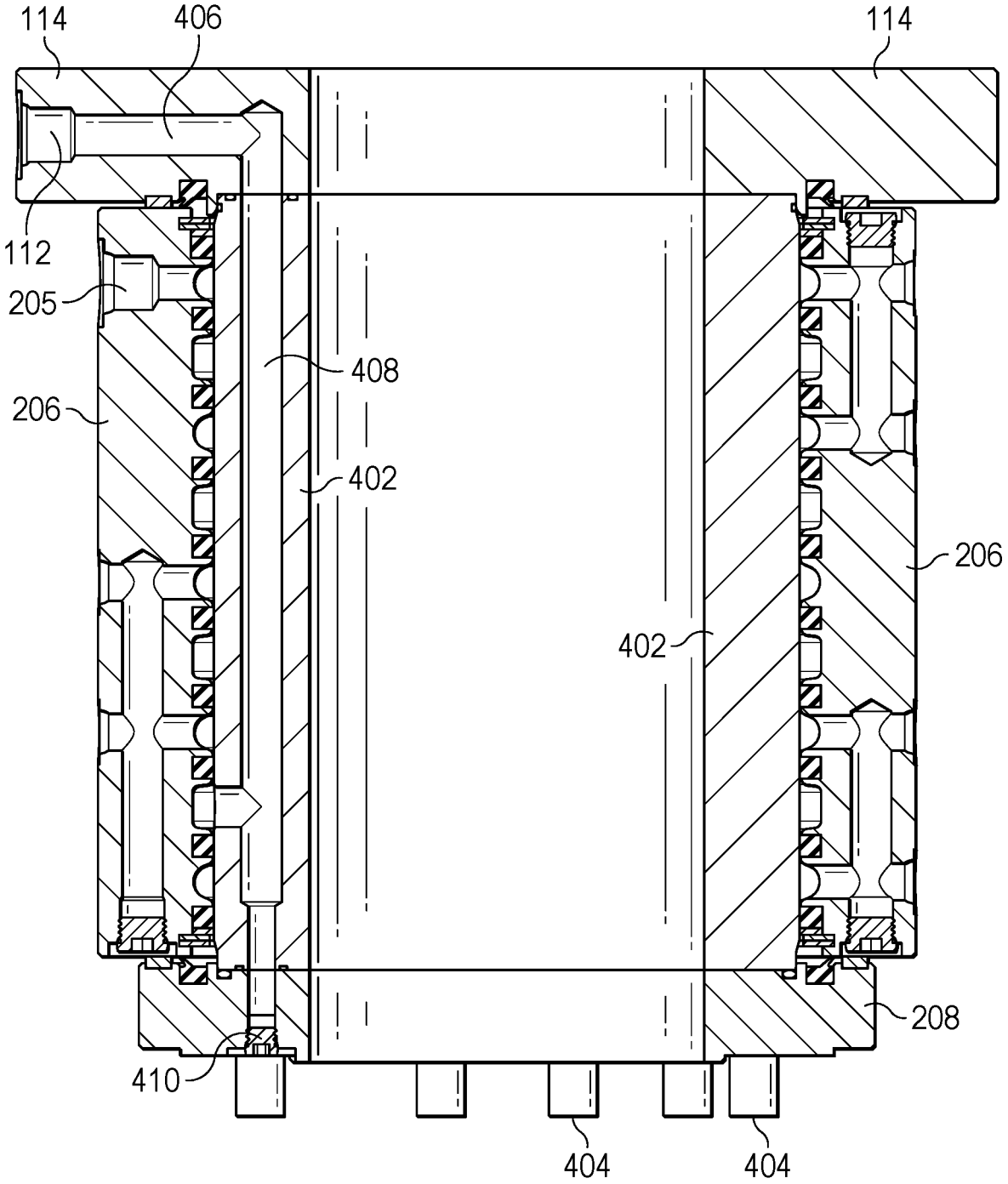
FIG. 4 illustrates a cross-sectional view of a swivel.

In order to provide hydraulic power from the swivel 102 through the rotary 110 to locations below the rotary table 104, the swivel 102 and swivel housing 206 can be configured in the manner more particularly illustrated in FIG. 4. Referring now more particularly to FIG. 4, there is illustrated a cross-sectional view of the swivel assembly. The swivel assembly includes the swivel housing 206 having the swivel spindle 402 located therein. The upper flange 114 rests on top of the swivel spindle 402. Extending below the upper flange 114 is the swivel spindle 402. The swivel spindle 402 extends downward through the swivel housing 206 and interconnects with the lower flange 208. The lower flange 208 includes studs 404 for bolting the swivel flange 208 to the rotary 110 to enable the swivel spindle 402 and rotary 110 to rotate together.

The cross-sectional view of FIG. 4 also illustrates the manner in which an input port 205 in swivel housing 206 is fluidly connected to output port 112 in the upper flange 114 through vertical channel 408 and horizontal channel 406. In the illustrated embodiment, the vertical channel 408 is formed within the swivel spindle 402. The horizontal channel 406 enables hydraulic fluid to flow out of the port 112 from the swivel flange 114. The vertical channel 408 also provides hydraulic fluid to an output port 410 at the lower flange 208 from the input port 205. As mentioned previously when hydraulic fluid is being provided to the output port 410 the output port 112 on the upper side will have a plug therein. Similarly when hydraulic fluid is being provided at the output port 112 the output port below the rotary table would have a plug therein.

Figure 5:
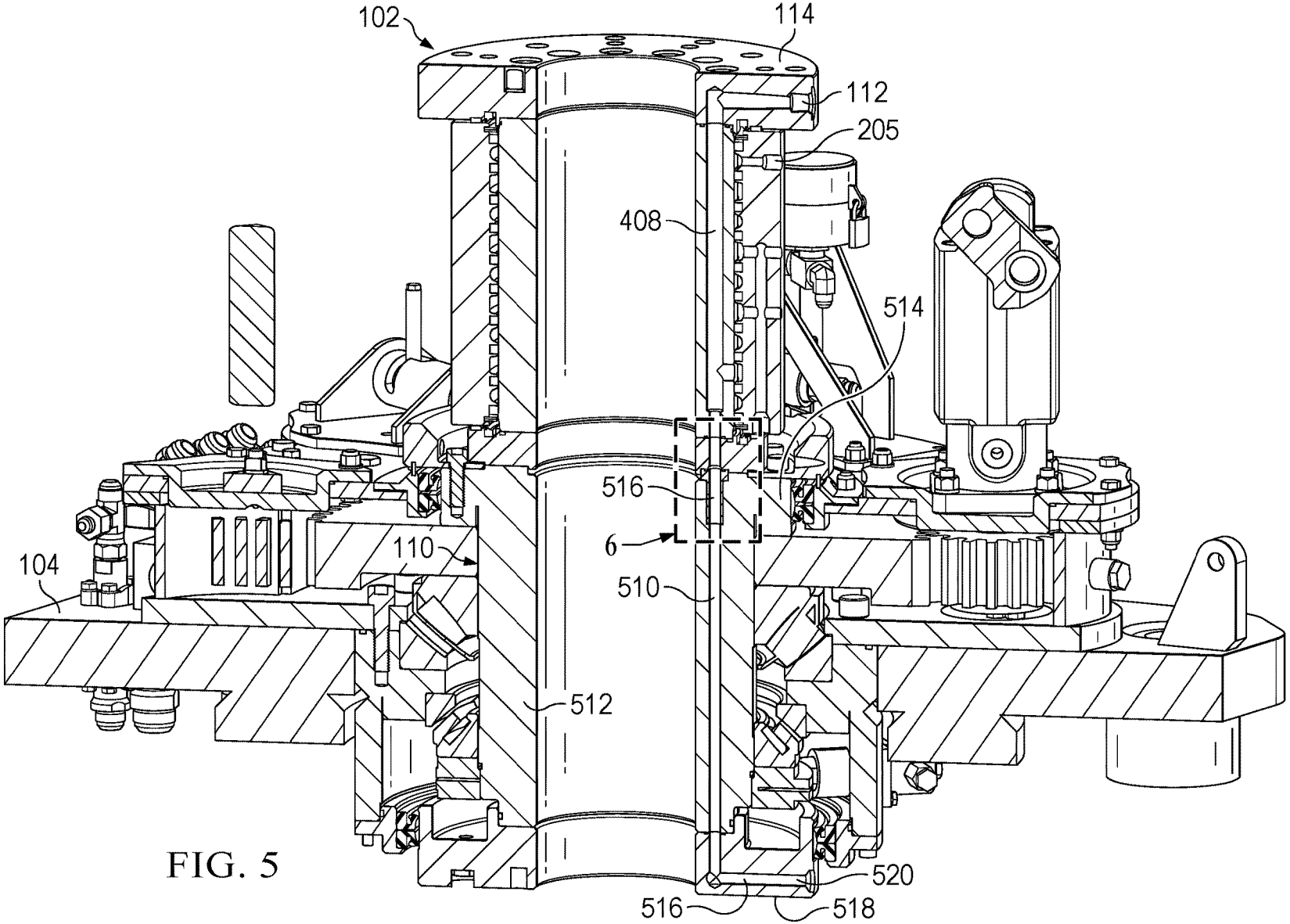
FIG. 5 illustrates a cross-sectional perspective view of the components for providing hydraulic power from the swivel through the rotary into a hydraulic port located below the rotary table.

Once the hydraulic fluid input at the input port 205 on the side of the housing 206 reaches the output port 410 in the lower flange 208, the hydraulic fluid can be provided through the rotary 110 (FIG. 5) that is mounted within the rotary table 104. The rotary 110 does not spin independently of the rotary table 104. The rotary 110 is hard mounted to the rotary table 101 and spins within itself. Referring now to FIG. 5, there is more particularly illustrated the manner in which hydraulic fluid may be provided from a port 205 on the side of the housing 206 of the swivel 102 to a port 520 at the bottom of the rotary 110. The vertical channel 408 through the swivel 102 aligns with, and is fluidly connected to, a second vertical channel 510 in the wall 512 of the rotary 110. The second vertical channel 510 aligns with the vertical channel 408 of the swivel spindle 402. The vertical channel 408 and the second vertical channel 510 are in a predetermined fixed relationship due to the lower flange 208 of the swivel 102 being bolted to the top flange 514 of the rotary 110. An interface adapter 516 fluidly interconnects the first vertical channel 408 of the swivel 102 with the second vertical channel 510 of the rotary 110 and will be more fully described hereinbelow in FIG. 6. The second vertical channel 510 provides hydraulic fluid from the interface adapter 516 to rotary flange channel 516 located in a bottom rotary flange 518. Hydraulic fluid originating at the port 205 in the housing of the swivel 102 above the rotary table 104 may thus be output from the bottom rotary flange 518 located below the rotary floor 104 via a port 520.

With the hydraulic port 520 located at the bottom of the rotary 110, hydraulic power may be provided by a permanent connection at the port 205 and delivered through the swivel 102 and the rotary 110 to power the lower slip bowl 108 or any other hydraulically powered device affixed to the lower portion of the rotary (e.g., to the bottom flange 518) below the rotary table 104. Since the rotary 110 and the lower slip bowl 108 (or other hydraulically powered device affixed to the rotary below the rotary table 104) rotate together, a permanent hydraulic connection can be provided between the hydraulic port 520 and the lower slip bowl or other device. In this manner, the making and breaking of temporary hydraulic connections needed to power equipment attached to the lower rotary 110 is eliminated, and the potentially dangerous activity of making and breaking temporary hydraulic connections below the rotary table 104 is no longer needed. In other words, the system and method described herein does not require connection and disconnection of hydraulic lines thus limiting the previous safety concerns to rig workers when connecting and removing these hydraulic hoses.

Figure 6:
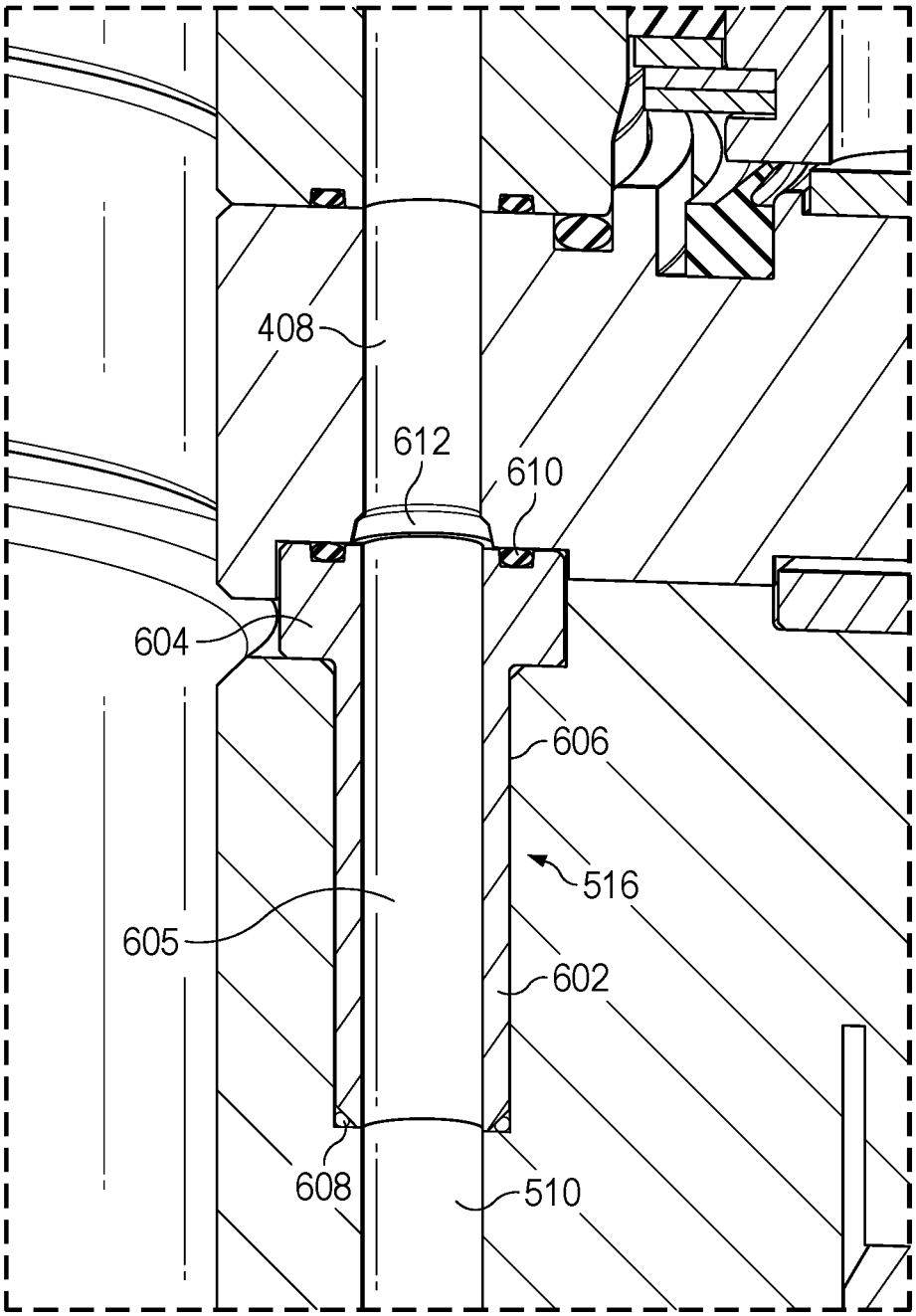
FIG. 6 illustrates a side view of the interface adapter between the swivel and the rotary table.

Referring now to FIG. 6, there is provided an enlarged side view of one embodiment of the interface adapter 516 for fluidly interconnecting the vertical channel 408 associated with the swivel 102 and the second vertical channel 510 associated with the rotary 110. It should be appreciated that the interface adapter 516 may be implemented in other configuration or may not even be needed in other embodiments of the system. The interface adapter 516 comprise an annular shaft portion 602 extending from a larger diameter annular head portion 604, with the shaft and head portions collectively defining a continuous passageway 605 extending therethrough. The interface adapter 516 fits within a cavity 606 defined within the swivel 102 and rotary 110 and passes there between. The passageway 605 of the interface adapter 516 fluidly interconnects the vertical channel 408 with the second vertical channel 510. A first O-ring 608 can be provided at the bottom of the interface adapter 516 to prevent hydraulic fluid from leaking at the bottom of the interface adapter. A second O-ring 610 can be provided on a top surface of the head portion 604 to prevent the leakage of hydraulic fluid at the top of the interface adapter 516. A gasket 612 can be provided on the top surface of the head portion 604 and the interior of the gasket can threadingly engage the vertical channel 408 to help prevent leakage out of the top surface of the head portion. With the interface adapter 516 installed, hydraulic fluid may then flow from the swivel 102 to the rotary 110 without leakage of the hydraulic fluid.

Although the routing of hydraulic fluid from a single port 205 in the housing of the swivel 102 to a single port 520 on the rotary 110 has been describe in detail, some embodiments may include multiple ports 205', 205", 205'", etc. on the swivel 102, with each such swivel port being connected to a respective port 520', 520", 520'", etc. on the rotary 110 in a manner similar to that described in detail. It will also be appreciated that in some cases the direction of hydraulic fluid flow between some ports 205 and their respective ports 520 may be reversed from that described, e.g., for a hydraulic fluid return line from the hydraulically powered device connected to the rotary 110.

It will be appreciated by those skilled in the art having the benefit of this disclosure that this system and method for providing power below a swivel and rotary table provides an improved manner for providing hydraulic power through a swivel and rotary without requiring external hoses. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. An apparatus for providing hydraulic power below a snubbing unit, comprising:

a swivel assembly having at least one hydraulic port therein, the swivel assembly defining a first hydraulic channel connected to the at least one hydraulic port;

a rotary table;

a rotary mounted within the rotary table having a second hydraulic port therein below the rotary table, the rotary defining a second hydraulic channel therein connected to the second hydraulic port, wherein the rotary is connected to the swivel assembly such that the first hydraulic channel aligns with the second hydraulic channel to provide for hydraulic fluid flow therebetween;

wherein hydraulic fluid is provided from the at least one hydraulic port through the first hydraulic channel of the swivel assembly and the second hydraulic channel of the rotary to the second hydraulic port below the rotary table; and a lower slip bowl connected to the rotary below the rotary table and receiving the hydraulic power from the second hydraulic port below the rotary table.

2. The apparatus of claim 1 further comprising an interface adapter located at an interface between the swivel assembly and the rotary to interconnect the first hydraulic channel and the second hydraulic channel.

3. The apparatus of claim 2, wherein the interface adapter prevents leakage of hydraulic fluid between the swivel assembly and the rotary at the interconnection between the first hydraulic channel and the second hydraulic channel.

4. The apparatus of claim 2, wherein the interface adapter further comprises:

an annular shaft portion;

a larger diameter annular portion located on top of the annular shaft portion;

a first O-ring located on a bottom surface of the annular shaft portion; and a second O-ring located on a top surface of the larger diameter annular portion.

5. The apparatus of claim 1, wherein the second hydraulic port below the rotary table further interconnects with a hydraulically powered mechanism located below the rotary table.

6. The apparatus of claim 1, wherein the swivel assembly further comprises:

a swivel housing defining an opening therein and having a lower swivel housing flange for connecting the swivel housing to the rotary;

a swivel including a first portion that inserts into the swivel housing and a swivel flange that connects to a top edge of the first portion;

wherein the at least one hydraulic port is located on the swivel housing;

wherein the swivel housing defines a first portion of the first hydraulic channel; and wherein the first portion of the swivel defines a second portion of the first hydraulic channel that runs a length of the first portion of the swivel.

7. The apparatus of claim 1, wherein the rotary further comprises:

a first cylinder portion that connects to a lower swivel housing flange;

a lower rotary flange that connects to a bottom edge of the first cylinder portion of the rotary;

wherein the second hydraulic port is located on the lower rotary flange;

wherein the lower rotary flange defines a first portion of the second hydraulic channel; and wherein the first cylinder portion of the rotary defines a second portion of the second hydraulic channel that runs a length of the first cylinder portion of the rotary and interfaces with a second portion of the first hydraulic channel.

8. An apparatus for providing hydraulic power below a snubbing unit, comprising:

a swivel assembly having at least one hydraulic port therein, the swivel assembly defining a first hydraulic channel connected to the at least one hydraulic port, wherein the swivel assembly further comprises:

a swivel housing defining an opening therein and having a lower swivel housing flange;

a swivel including a first portion that inserts into the swivel housing and a swivel flange that connects to a top edge of the first portion;

wherein the at least one hydraulic port is located on the swivel flange;

wherein the swivel flange defines a first portion of the first hydraulic channel; and wherein the first portion of the swivel defines a second portion of the first hydraulic channel that runs a length of the first portion of the swivel;

a rotary table;

a rotary mounted within the rotary table having a second hydraulic port therein below the rotary table, the rotary defining a second hydraulic channel therein connected to the second hydraulic port, wherein the rotary further comprises:

a first cylinder portion that connects to the lower swivel housing flange;

a lower rotary flange that connects to a bottom edge of the first cylinder portion of the rotary;

wherein the second hydraulic port is located on the lower rotary flange;

wherein the lower rotary flange defines a first portion of the second hydraulic channel; and wherein the first cylinder portion of the rotary defines a second portion of the second hydraulic channel that runs a length of the first cylinder portion of the rotary and interfaces with the second portion of the first hydraulic channel;

wherein the rotary is connected to the swivel assembly such that the first hydraulic channel aligns with the second hydraulic channel to provide for hydraulic fluid flow therebetween; and wherein hydraulic fluid is provided from the at least one hydraulic port through the first hydraulic channel of the swivel assembly and the second hydraulic channel of the rotary to the second hydraulic port below the rotary table.

9. The apparatus of claim 8 further comprising an interface adapter located at an interface between the swivel and the rotary to interconnect the first hydraulic channel and the second hydraulic channel.

10. The apparatus of claim 9, wherein the interface adapter prevents leakage of hydraulic fluid between the swivel and the rotary at the interconnection between the first hydraulic channel and the second hydraulic channel.

11. The apparatus of claim 9, wherein the interface adapter further comprises:

an annular shaft portion;

a larger diameter annular portion located on top of the annular shaft portion;

a first O-ring located on a bottom surface of the annular shaft portion; and a second O-ring located on a top surface of the larger diameter annular portion.

12. The apparatus of claim 8 further comprising a lower slip bowl connected below the rotary table and receiving the hydraulic power from the second hydraulic port below the rotary table.

13. The apparatus of claim 8, wherein the second hydraulic port below the rotary table interconnects with a hydraulically powered mechanism located below the rotary table.

14. A method for providing hydraulic power below a snubbing unit, comprising:

defining a first hydraulic channel connected to at least one hydraulic port in a swivel assembly;

defining a second hydraulic channel within a rotary mounted within a rotary table connected to a second hydraulic port located below the rotary table;

connecting the rotary to the swivel assembly such that the first hydraulic channel aligns with the second hydraulic channel to provide for hydraulic fluid flow therebetween;

providing hydraulic fluid from the at least one hydraulic port through the first hydraulic channel of the swivel assembly and the second hydraulic channel of the rotary to the second hydraulic port below the rotary table;

connecting a hydraulically powered mechanism below the rotary table; and receiving the hydraulic fluid to power the hydraulically powered mechanism from the second hydraulic port below the rotary table.

15. The method of claim 14 further comprising locating an interface adapter located at an interface between the swivel assembly and the rotary to interconnect the first hydraulic channel and the second hydraulic channel and prevent leakage of the hydraulic fluid between the swivel assembly and the rotary.

16. The method of claim 14, wherein the hydraulically powered mechanism comprise a slip bowl.

17. The method of claim 14, wherein the step of defining the first hydraulic channel in the swivel assembly further comprises:

defining a first portion of the first hydraulic channel in a swivel flange of the swivel assembly that connects to the at least one hydraulic port; and defining a second portion of the first hydraulic channel that runs a length of the first portion of the swivel assembly and connects to the first portion of the first hydraulic channel.

18. The method of claim 14, wherein the step of defining the second hydraulic channel in the rotary further comprises:

defining a first portion of the second hydraulic channel in a lower rotary flange of the rotary that connects to the second hydraulic port; and defining a second portion of the second hydraulic channel that runs a length of a first cylinder portion of the rotary and interfaces with the first portion of the first hydraulic channel.

19. An apparatus for providing hydraulic power below a snubbing unit, comprising:

a swivel assembly having at least one hydraulic port therein, the swivel assembly defining a first hydraulic channel connected to the at least one hydraulic port;

a rotary table;

a rotary mounted within the rotary table having a second hydraulic port therein below the rotary table, the rotary defining a second hydraulic channel therein connected to the second hydraulic port, wherein the rotary is connected to the swivel assembly such that the first hydraulic channel aligns with the second hydraulic channel to provide for hydraulic fluid flow therebetween;

wherein hydraulic fluid is provided from the at least one hydraulic port through the first hydraulic channel of the swivel assembly and the second hydraulic channel of the rotary to the second hydraulic port below the rotary table; and a hydraulically powered mechanism connected below the rotary table and receiving the hydraulic fluid to power the hydraulically powered mechanism from the second hydraulic port below the rotary table.

* * * * *